United States Patent [19]

Amano et al.

[11] Patent Number: 4,624,976

[45] Date of Patent: Nov. 25, 1986

[54] MODELING MATERIAL COMPOSITION

[75] Inventors: Osamu Amano, Yokohama; Atsushi Kaiya, Kawasaki; Takao Tanaka, Tokyo; Hitoshi Akimura, Ube; Katsuhiro Tsujihata, Ube; Kouji Hirata, Ube, all of Japan

[73] Assignees: Nippon Petrochemicals Co., Ltd.; Ube Cycon, Ltd., both of Tokyo, Japan

[21] Appl. No.: 757,553

[22] Filed: Jul. 22, 1985

[30] Foreign Application Priority Data

Jul. 20, 1984 [JP] Japan ..... 59-149657

[51] Int. Cl.[4] ..... C08J 5/06; C08L 97/02; B22C 1/00

[52] U.S. Cl. ..... 524/13; 524/504; 523/139; 523/140; 523/141

[58] Field of Search ..... 524/13, 504, 14; 523/139, 140, 141

[56] References Cited

U.S. PATENT DOCUMENTS 3,728,294 4/1973 Levine ..... 524/13
3,976,608 8/1976 Buckler et al. ..... 524/13

FOREIGN PATENT DOCUMENTS 0015843 5/1978 Japan ..... 524/13

*Primary Examiner*—John Kight
*Assistant Examiner*—Nathan M. Nutter
*Attorney, Agent, or Firm*—Sughrue, Mion, Zinn, Macpeak & Seas

[57] ABSTRACT

A composition for modeling material comprising a synthetic resin, a wooden powder and an oil formulated and kneaded. The synthetic resin is a rubber-reinforced styrene resin. The oil is a hydrocarbon oil having a specified viscosity, and restriction of the content of an aromatic ring-forming carbon. The composition is formed into flat board, round rod, etc. and used as modeling material for shaping patterns or models.

11 Claims, No Drawings

MODELING MATERIAL COMPOSITION

BACKGROUND OF THE INVENTION

1. Field of the Invention

The present invention relates to a novel composition for modeling material.

The modeling material herein referred is the material for shaping model or pattern of any desired shape by cutting by hand-work or machine-work.

The model or pattern includes the following examples without being limited to them.

(1) Pattern for forming a sand mold which is used for casting of metal such as iron or aluminum.

(2) Model for casting of gypsum or epoxy resin.

(3) Profiling model for the cutting or machining operation of metal, resin, wood, etc.

(4) Mock-up model.

(5) Test cutting material for the examination of numerical control machine tools. The machine tool of the numerical control system is operated by a program. In order to examine the accuracy of the program applied, it is necessry to effect a preliminary cutting.

2. Description of the Prior Art

The modeling materials heretofore used includes wood materials such as Japanese cypress, Japanese white pine, Japanese cedar, and mahogany; resins such as epoxy resins and urethane resins; gypsum; and metals such as aluminum, zinc alloys, and iron. However, they are not satisfactory in both aspects of performance and price. Thus development of a new material has been desired.

For example, before production of a sand casting model pattern requiring a modeling material meeting the most severe requirements, a model is first made of wood inexpensively such as Japanese cypress or Japanese white pine, which is easy to subject to the cutting or machining operation, and the shape of the wooden model is transferred to a sand mold. Using this sand mold, a casting of iron, aluminum, or the like is empirically produced. The pattern may be corrected on a trial-and-error basis while confirming whether or not caves or voids are formed in the test casting, and whether or not the test casting is satisfactory is strength or size precision. The material of the pattern is finally determined with consideration for the necessary quantity of castings to be produced. In general, where the number of castings to be produced is supposed to be several hundred or less, the wooden pattern is used as such. Where the number is supposed to be less than 5,000, a pattern made of an epoxy resin is mainly used. Where the number is supposed to be about 20 to 30 thousand, a pattern made of an aluminum alloy is used, while a steel pattern is used in the case of the number being further larger. Why the material of the pattern varies depending on the scale of production is that the size of the pattern changes due to abrasion thereof by the molding sand. Even if the number of castings to be produced is smaller, steel or an aluminum alloy is used for a pattern required to have a high dimensional accuracy and a model having such a complicated shape that it is impossible to produce the pattern from wood.

The following performance characteristics are required of the modeling material. (1) It is uniform, and has neither voids nor pinholes in the inside. (2) It has good machinability and freedom of shaping in manual and mechanical operations. (3) It has good dimensional stability and accuracy. (4) It has adequate rigidity, toughness, and surface hardness. (5) It is desired to have good adhesion. In the case of a pattern for a sand mold, the modeling material is required to further have, for example, the following performance characteristics. (6) It has good abrasion resistance against molding sand. (7) It has good chemical resistance against a curing agent, etc. contained in the molding sand. (8) It has good releasability from the molding sand. (9) It is easy to repair.

The most inexpensive modeling materials widely employed are natural wood materials such as Japanese cypress, Japanese white pine, or mahogany. However, large trees of 600 mm or more in diameter suitable as the modeling material have recently been less and less available owing to gradual exhaustion of wooden resources. Even if such trees can be acquired, sufficient drying thereof for one to two years is necessary before they can be used as the modeling material. If the drying is insufficient, the wood material is subject, after cutting machining operation, to marked dimensional changes and deformation, occasionally leading to breakage thereof. Large storing space and inventory burden during the drying period cannot be neglected.

The biggest defect of wood as the modeling material is marked dimensional changes due to moisture absorption or desorption, particularly a large anisotropy in dimensional changes (tangential direction:radial direction:axial direction $=10:5:1\sim0.5$). Even a high quality Japanese cypress having the best dimensional accuracy is 0.14 to 0.27% in average tangential shrinkage (dimensional change rate due to a 1% decrease in water content from a water content of 15%). Furthermore, only straight-grained wood materials can be employed as the modeling material, while cross-grained wood materials are subject to too large warping to employ as the modeling material. Wood materials of the portion close to the bark, such as sapwood, are excluded from use as the modeling material, too.

It is believed that the wood material is excellent in machinability as compared with other modeling materials. However, this applies only in the case of manual processing by means of a chisel or a plane used by a woodcraftsman. In the machining opration by a machine tool, the feeding direction of the tool may be either along the grain, namely along the growth direction of wood, or against the grain. When it is against the grain, the wood may be cleft, making the machining operation impossible. For this reason, many wooden models are protruded models, while recessed models as profiling models for stamping forging are seldom wooden. Further, in the ball end mill processing, fluffing of a wood fiber occurs, requiring sanding after cutting by a cutting tool. In the cutting or machining operation at slow revolution by a metal processing machine, a wood fiber can not be sharply cut and hence fluffing occurs. Thus an exclusive wood processing machine capable of rapid revolution is required. Production of a wooden model for a portion of a small thickness such as a radiator blade of an air-cooled engine or a portion of an acute angle of 90° or less encounters a serious difficulty, since breakage of wood during the cutting or machining operation may occur due to a low tenacity of wood. Even if the cutting or machining operation is completed after many troubles, the wooden model may be subject to unexpected deformation due to moisture absorption caused by a weather change. As described above, a stable model of high dimensional accuracy is limited in production thereof from wood.

A large amount of epoxy resins and urethane resins are used for a pattern having higher dimensional stability and abrasion resistance than the wooden pattern. However, since cutting of a resin by a cutting tool is almost impossible, a resin model is produced by a casting method comprising first preparing a wooden model, transferring the shape of the same to a gypsum mold, and casting an epoxy resin thereinto to effect reverse transfer. Therefore, casted epoxy resin models are naturally expensive, and the delivery time thereof is liable to be long, as compared with wooden models. Furthermore, the resin model produced by casting may frequently have voids or pinholes inside, and is poor in releasability from sand in the case of use thereof as a casting pattern. It is apparent that aluminum alloys and copper are much poorer in machinability than wood.

The model industry is making efforts to achieve a high dimensional accuracy of models and to realize a short delivery time as well as a price cut. Thus development of a material satisfying various performance characteristics as hereinbefore mentioned under (1) to (9) has been earnestly desired.

SUMMARY OF THE INVENTION

The present invention, which has been completed as a result of intensive investigations with a view to meeting the above-mentioned desire, is related to a modeling material having an excellent dimensional stability, a good abrasion resistance against molding sand, and a good releasability from the molding sand, which can be easily subjected to the cutting or machining operation either by a chisel, a plane, etc. manually employed by a craftsman, or by either of a high-speed wood cutting machine and a low-speed metal cutting machine.

More specifically, in accordance with the present invention, there is provided a modeling material composition comprising a hydrocarbon oil having a viscosity of 10 to 500 cSt (100° F.) and an aromatic ring-forming carbon atom content ($C_A$) of 20 wt.% or less, a wooden powder, and a rubber-reinforced styrene resin, said wooden powder (in an air-dried state) being present in an amount of 10 to 40 weight % based on the total of said wooden powder and said rubber-reinforced styrene resin, said hydrocarbon oil being added in an amount of 10 to 50 weight parts per 100 weight parts of said wooden powder (in an air-dried state).

DETAILED DESCRIPTION OF THE INVENTION

[Rubber-Reinforced Styrene Resin]

Any kind of resin may be used as the rubber-reinforced styrene resin to be used in this invention so far as it can provide enough elasticity and tenacity for the modeling material of this invention to enable the cutting or machining operation to be made even in a portion of a small thickness or an acute angle, and increase the freedom of model shaping and abrasion resistance against molding sand.

More specifically, the rubber-reinforced styrene resin is a styrene resin having a two-phase structure essentially consisting of a continuous phase (a matrix phase) of a styrene resin and a dispersion phase of a rubber polymer and/or a rubber polymer bonding to the styrene resin graft-polymerized therewith. Examples of the rubber polymer used in the dispersion phase include butadiene-based rubber polymers such as polybutadiene, butadiene-styrene copolymers, and butadiene-acrylonitrile copolymers; and other rubber polymers such as polyacrylic esters, ethylene-propylene-diene coploymers (EPDM), and chlorinated polyethylene. They may be used either alone or in mixture.

On the other hand, styrene and/or an aromatic vinyl compound(s) of styrene derivative can be used as the graft monomer of the monomer for the continuous phase. If necessary, a comonomer may be used together with the above-mentioned monomer(s). Examples of the comonomer include vinyl cyanide compounds, acrylic esters, methacrylic esters, and unsaturated dicarboxylic acids and their anhydrides. The rubber component content of the rubber-reinforced styrene resin is 5 to 40 wt.%, preferably 10 to 30 wt.%. If it is less than 5 wt.%, there arises a grave danger of breakage of a model produced from the modeling material in the portion of a small thickness or an acute angle. If it is more than 40 wt.%, the rigidity of the modeling material is too low.

[Wooden Powder]

A variety of wood meals, pulp powders, etc. can be employed as the wooden powder in the present invention. Wood meals of coniferous trees such as Japanese hemlock, Himalayan cedar, Japanese cypress, incense cedar, or Japanese white pine are preferred since they have a low specific gravity in an air-dried state and a moisture resistance. The water content of the wooden powder is 13 to 18 wt.% in an air-dried state thereof. The particle size of the wooden powder is such that it will allow 90 wt.% or more of the wooden powder to pass through a 60-mesh sieve (mesh size: 0.246 mm), preferably to allow all of the wooden powder to pass through an 80-mesh sieve (mesh size: 0.175 mm). It is desirable to avoid using a rougher wooden powder than a 60-mesh level of powder since it may provide a rough surface for a model.

The necessary amount of the wooden powder in an air-dried state is 10 to 40 wt.% based on the total amount of the rubber-reinforced styrene resin and the wooden powder. If the amount of the wooden powder is less than 10 wt.%, the modeling material cannot have good machinability with a cutting tool and mechanical strength. On the other hand, if it is more than 40 wt.%, the compatibility of the wooden powder with the rubber-reinforced styrene resin is reduced, and the freedom of cutting or machining is lowered as can be seen in frequent chipping off of an acute angle corner of a model being produced owing to lowered flexibility and tenacity of the modeling material and in a difficulty encountered in production of a thin-walled model.

[Hydrocarbon Oil]

The hydrocarbon oil to be used in the present invention has a viscosity of 10 to 500 cSt as measured at 100° F. and an aromatic ring-forming carbon atom content ($C_A$) of 20 wt.% or less. The hydrocarbon oil includes the one having a $C_A$ of 0 wt.%.

Preferred examples of the hydrocarbon oil as described above include synthetic and mineral hydrocarbon oils, which may have a chemical structure of a paraffin type, a naphthene type, a mixture of the preceding two, or a mixture of either of the two with an aromatic type.

Specifically, liquid paraffin, and mineral and synthetic process oils are preferred.

The hydrocarbon oil is added not only to facilitate mixing or kneading of the wooden powder and the rubber-reinforced styrene resin, but also to improve machinability of the modeling material with a cutting tool. Another purpose of addition of the hydrocarbon oil is to allow the hydrocarbon oil to be adsorbed onto and/or infiltrated into the wooden powder for substitution of the hydrocarbon oil for water in the wooden powder, which prevents not only foaming due to water evaporation at the time of kneading and/or forming and hence the formation of voids or pinholes but also dimensional changes due to moisture absorption or desorption of a modeling material formed.

A hydrocarbon oil having a viscosity of less than 10 cSt as measured at 100° F. is liable to have such a low boiling point that it cannot be employed because foaming is apt to occur at a die opening, etc. of a screw extruder for extruding a kneaded mixture of the rubber-reinforced styrene resin and the wooden powder. On the other hand, a hydrocarbon oil having a viscosity of higher than 500 cSt as measured at 100° F. is insufficient in impregnation of the wooden powder therewith, and provides a modeling material requiring a powerful cutting force and having a sticky surface. A hydrocarbon oil having a $C_A$ of higher than 20 wt.% is generally colored blackish brown or deep green, so that it exerts an adverse influence on the color of the modeling material. Furthermore, such a hydrocarbon oil exercises only a limited effect of improving the machinability and reduces the rigidity and releasability from molding sand of the modeling material.

The amount of the hydrocarbon oil is 10 to 50 weight parts per 100 weight parts of the wooden powder (calculated in terms of an amount of an air-dried wooden powder). If it is less than 10 weight parts, the easiness of the kneading operation and the machinability of the modeling material cannot be improved. If it is more than 50 weight parts, there appear defects that some free hydrocarbon oil not absorbed onto and/or not infiltrated into the wooden powder remains, and that the rigidity and releasability from molding sand of the modeling material formed are redued. [Process]

The processes for preparing the modeling material composition of the present invention and for forming a modeling material therefrom will now be described.

The order of mixing the rubber-reinforced styrene resin, the wooden powder, and the hydrocarbon oil is not particularly limited. However, it is preferred to preliminarily make the wooden powder adsorb thereon or to be impregnated with the hydrocarbon oil.

The wooden powder is preferably at least in an air-dried state. A wooden powder having a high water content is preliminarily heat-dried for water removal before use thereof. Drying of a wooden powder to an absolutely dried state may be done if desired.

It is especially preferable to add the hydrocarbon oil to the wooden powder being heated and stirred. This is because such a procedure enables water in the wooden powder to be completely substituted by the hydrocarbon oil. The heating temperature in this procedure is preferably 100° to 200° C. when the wooden powder is in an air-dried state. The heating time is a time required for exchange of water in the wooden powder for the hydrocarbon oil and hence it varies depending on the water content of the wooden powder. It is preferably about 5 minutes to 1 hour.

For example, the wooden powder in an air-dried state is put into the mixing vessel of a rotating blade type mixer capable of heating and equipped with a jacket (a Henschel mixer). The temperature of the wall of the mixing vessel has been raised to about 140° C. by passing a low-pressure steam of about 3 kg/cm$^2$ through the jacket. A hydrocarbon oil is added dropwise to the wooden powder while rotating the rotating blade at a high velocity. When the wooden powder has insufficient dryness and a high water content, the wooden powder may be arbitrarily heat-dried before addition of the hydrocarbon oil. When a wooden powder is in an air-dried state, the wall temperature of the mixing vessel and the time of hydrocarbon oil addition treatment are usually 100° to 150° C. and about 5 to 15 minutes, respectively.

A temperature exceeding 200° C. must be avoided for the hydrocarbon oil addition treatment because otherwise there arises a fear of the wooden powder and/or the hydrocarbon oil being denatured or carbonized, and/or a danger of ignition thereof occurring when the flash point of the hydrocarbon oil allows it. Under normal pressures and at a temperature of lower than 100° C., escaping of water from the wooden powder and adsorption of the hydrocarbon oil on the wooden powder and/or impregnation of the wooden powder with the hydrocarbon oil may be insufficient, leading to frequent formation of voids due to evaporation of water during formation of the modeling material. Any voids in the modeling material constitute a fatal defect for the modeling material like blowhole in castings. Preliminary adsorption of the hydrocarbon oil on the wooden powder and/or preliminary impregnation of the wooden powder with the hydrocarbon oil, and the temperature condition of such treatments are indispensably such that visibly large voids may not be formed in the modeling material during the course of production of the modeling material from the modeling material composition of the present invention.

After addition of the hydrocarbon oil to the wooden powder to effect the adsorption or impregnation treatment, the rubber-reinforced styrene resin preferably in the form of a powder is added thereto in an amount that will provide 10 to 40 wt.% (calculated in terms of an amount of air-dried wooden powder) of the wooden powder based on the total amount of the wooden powder and the rubber-reinforced styrene resin. The resulting mixture is stirred and mixed at 100° to 150° C. for 5 to 30 minutes. In transferring the mixture to the subsequent step of pelletizing, it is desirable that the mixture be in a state of granules rather than in a state of a molten mass constituted by the whole mixture.

The mixture thus obtained is kneaded and pelletized in a molten state of the rubber-reinforced styrene resin by a combination of an ordinary thermoplastic resin kneading apparatus such as a single axial or twin axial screw extruder, a calender roll, a pressure kneader, or a Banbury mixer with a pelletizer.

The modeling material composition of the present invention may further comprise a pigment, an anti-oxidizing agent, an ultraviolet light absorber, a filler, a foaming agent, and antistatic agent, a fire retardant, etc., if desired.

The pellets of the modeling material composition are formed into an arbitrary shape by an injection molding machine, a screw extruder, a heat press, or the like. In the case of use as the modeling material, it is convenient to form a flat board having a thickness of about 5 to 50 mm or a round rod having a diameter of about 10 to 100 mm. The modeling material formed in the form of a flat board or a round rod may be manually processed by a chisel, a plane, a saw, a gimlet, a sand paper, etc. to produce a variety of models as desired. The modeling material can be arbitrarily subjected to bonding with an adhesive of an epoxy resin, a urethane resin, an acrylic resin, or the like. Besides, a tapping screw hole can be formed in a piece of the modeling material and used in connecting with another piece of the modeling material, other wood materials, metal, or the like with a metal bolt or the like.

The modeling material formed from the composition of this invention can be subjected to the cutting or machining operation either with wood cutting machines, such as a circular saw, a band saw, a planer, a wood lathe, a drill, or a router, just like wood, or with metal cutting machines, such as a lathe, a milling machine, a grinder, or a boring machine, just like metals.

(Examples)

The following examples will specifically illustrate the present invention.

EXAMPLE 1

(1) Step of Adding Hydrocarbon Oil to Wooden Powder

A steam of 3 kg/cm$^2$ was passed through the heating jacket of a Henschel mixer to raise the wall surface temperature of the mixing vessel to 130° C. A powder (all passing through a 60-mesh sieve) of Himalayan cedar dried at 110° C. for 3 hours was put into the mixing vessel. A hydrocarbon oil [naphthenic process oil: SUNTHENE 250 manufactured by Sun Oil Ltd., $C_A$: 5 wt.%, viscosity: 107 cSt (100° F.)] was dropwise added to the wooden powder (cedar powder) being stirred at a Henschel blade revolution of 1,800 rpm. After 10 minutes, the revolution of the Henschel blade was stopped. It was confirmed that the hydrocarbon oil was sufficiently adsorbed on and sufficiently infiltrated into the wooden powder, and that substantially no free hydrocarbon oil remained on the wall surface of the mixing vessel. The amount of the hydrocarbon oil added was 20 weight parts per 100 weight parts of the wooden powder in an air-dried state.

The completion of adsorption of the hydrocarbon oil on the wooden powder and impregnation of the wooden powder with the hydrocarbon oil was confirmed by observing that no free hydrocarbon oil remained on the wall surface of the mixing vessel after sufficient stirring and mixing, and that the wooden powder subjected to the adsorption and impregnation treatment was not sticky and had good flowability.

(2) Step of Mixing Resulting Mixture with Rubber-Reinforced Polystrene Resin

An ABS resin powder having a rubber component of 20 wt.% [Blendex 201 manufactured by Ube Cycon, Ltd.] was added to the hydrocarbon oil-adsorbed and -impregnated wooden powder in such an amount as to provide 20 wt.% of the wooden powder based on the total amount of the ABS resin and the wooden powder, followed by mixing in the mixer used in step (1) at 130° C. for 15 minutes. The resulting mixture was in the form of granules.

(3) Step of Melt Kneading by Screw Extruder and Pelletizing

Granules of the above-mentioned mixture were kneaded with a 40 mmϕ monoaxial screw extruder, and pelletized into cylindrical pellets of about 4 mm in diameter and about 5 mm in length like general thermoplastic resins.

(4) Forming and Evaluation of Modeling Material

Pellets thus formed are shaped into $\frac{1}{2}''\times\frac{1}{2}''\times 5''$ square bars by a screw-in-line injection molding machine having a shot capacity of 50 cm$^3$. Using these rods, the bending rigidity, cutting force, sensuous machinability, and amount of abrasion were examined. The results are shown in Table.

Testing Method for Machinability (Cutting Force) of Modeling Material

For numerical comparison of machinability of a modeling material with a cutting tool, the modeling material was bitten with a handicraft knife, and the force required for biting at this time was measured by a tensile testing machine (Autograph manufactured by Shimadzu Seisakusho Ltd.). The measured value was defined as the "cutting force". The results are shown in Table.

Testing Method for Abrasion Resistance of Modeling Material

Molding silica sand No. 3 and water were mixed at a weight ratio of 3:2. A $\frac{1}{2}''\times\frac{1}{2}''\times 5''$ rectangular parallelepiped modeling material was rotated at 500 rpm while its 100 mm-long portion from one end thereof was being in contact with the mixture of silica sand and water. After 3-hours rotation, the amount of the modeling material abraded was measured. The results are shown in Table.

EXAMPLE 2

Beside using wooden powder of incense cedar, substantially the same rubber-reinforced styrene resin, apparatuses, and conditions as employed in steps (1) to (4) of Example 1 were employed. 30 weight parts of a paraffin process oil [Sunper 110 manufactured by Sun Oil Ltd., $C_A$: 4 wt.%, viscosity: 23.8 cSt (100° F.)] was used for adsorption on and impregnation of 100 weight parts of the wooden powder, followed by addition of the ABS resin powder in an amount that will provide 20 wt.% of the wooden powder based on the total amount of the wooden powder and the ABS resin. Mixing was continued at 130° C. for 15 minutes. The resulting mixture was melt-kneaded and pelletized by a 40 mmϕ single axial screw extruder. Pellets thus formed were shaped into a modeling material in the form of a square bar, and tested in the same manner as in Example 1. The results are shown in Table.

(5) Pellets were subjected to continuous extrusion molding by a 65 mmϕ single axial screw extruder to form flat boards of 30 mm in thickness and 500 mm in width, which were cut at a length of 1 m.

(6) One of the flat boards was subjected on both the surfaces thereof to the machining operation by an end mill to form flat surfaces. Two pieces of the flat boards were mutually bonded with an epoxy resin adhesive to produce a block of 55 mm in thickness, 250 mm in width, and 500 mm in length. A recess of 460 mm in length and 65 mm in diameter with a half-circular crossection was formed in the central portion of the block by a metal processing NC cutting machine (SNF-105 manufactured by Makino Milling Machine Co., Ltd.). A cutter was a ball end mill of 5 mm in radius with two blades. The revolution of the cutter was 1,500 rpm and the feed rate was 1,000 mm/minute in the machining operation. A profile model having a very smooth surface was obtained. Scobs formed by the cutter during the machining operation were very thin leaves just like the one obtained in the case of good quality wood, and accompanied with little dust.

(7) A trapezoid piece of 52 mm in height, 40 mm in width, and 55 mm in length was manually formed from the above-mentioned flat board, and attached to the plate of a molding machine, Disamatic 2013 to produce 4,000 sand molds. The abrasion of the piece by the molding sand was only 0.3 mm at most, which is smaller than those of epoxy resin patterns. The releasability of the pattern from the molding sand was very good, too. Thus it was found that the model was sufficient in practical performance as the sand mold pattern for castings.

EXAMPLE 3

Substantially the same raw materials, apparatuses, and conditions as employed in steps (1) to (4) of Example 1 were employed. A mixture was prepared from 12.5 weight parts of the hydrocarbon oil per 100 weight parts of the wooden powder and 40 weight % of the wooden powder based on the total amount of the wooden powder and the rubber-reinforced styrene resin. The mixture was pelletized as in Example 2, and formed into square bars of modeling material as in Example 1 for testing. The results are shown in Table.

(5) A flat board of 30 mm in thickness and 500 mm in width was also formed.

It was confirmed that the flat board as the modeling material thus formed was readily subjected to the manual cutting operation by a chisel, a plane, etc. For examining the high-speed machinability of it with a wood cutting machine, the modeling material was further subjected to the machining operation by a high-speed NC router (NC-163C manufactured by Shoda Tekko Ltd.). A 10 mm end mill (two blades) was employed as the cutter. Grooves of 15 mm in depth were formed at a revolution of 3,000 to 18,000 rpm and a feed rate of 3,000 to 500 mm/minute. Even a very thin wall having a distance or thickness of 2 mm between grooves formed was neither broken nor chipped off. This could not be expected of wood. Furthermore, the cut surfaces were very smooth. Thus it was found that the modeling material according to this invention had characteristics of machinability and freedom of shaping that were never expected of the conventional modeling materials.

COMPARISON EXAMPLE 1

Substantially the same wooden powder, resin, apparatuses, and conditions as employed in Example 1 were employed except that no hydrocarbon oil was used. Specifically, the wooden powder and the ABS resin were mixed in a Henschel mixer, and melt-kneaded and pelletized by a 40 mmϕ screw extruder. The kneaded mass extruded from the die of the extruder was so foamed and so subject to strand cutting as to provide an extreme difficulty in pelletizing, which was in contrast with the easiness in pelletizing when the hydrocarbon oil was preliminarily added to the wooden powder in Example 1. Pellets formed in any way were formed into $\frac{1}{2}''\times\frac{1}{2}''\times 5''$ square bars with an injection molding machine, followed by testing. The results are shown in Table. The woodcraftman's evaluation of cutting ability or machinability with a chisel was that the molded square bar was very hard and whitened in the cut surfaces. Thus it was found that it is not suitable for producing a small precision model. The cutting force with a handicraft knife was as very large as 61 kg/cm.

COMPARISON EXAMPLE 2

Pellets of the same ABS resin as used in Example 1 were formed into $\frac{1}{2}''\times\frac{1}{2}''\times 5''$ square bars with an injection molding machine. The machinability of the square bar was evaluated in the same manner as in Comparison Example 1 to find that it was very hard as compared with wood and whitened in the cut surfaces. Thus it was not suitable as the modeling material. The cutting force with a handicraft knife was as large as 62 kg/cm to demonstrate poor machinability. The results are shown together with other evaluation results in Table.

COMPARISON EXAMPLE 3

Substantially the same wooden powder, ABS resin, apparatuses, and conditions as employed in Example 1 were employed. An aromatic process oil [Sundex 790 manufactured by Sun Oil Ltd., $C_A$: 37 weight %, viscosity 650 cSt (100° F.)] was used in an amount of 30 weight parts per 100 weight parts of the wooden powder for adsorption on and impregnation of the wooden powder. The ABS resin was then mixed with them in an amount that will provide an ABS resin content of 80 weight %. The mixture was very sticky and colored blackish brown. The mixture was formed into a $\frac{1}{2}''\times\frac{1}{2}''\times 5''$ square bar with a heat press. The bar was so sticky on the surfaces that it could not be used as the modeling material. The evaluation results are shown in Table.

COMPARISON EXAMPLE 4

$\frac{1}{2}''\times\frac{1}{2}''\times 5''$ square bars were formed by casting an epoxy resin for jigs (Araldite SW404, manufactured by Ciba-Geigy Ltd.), which is frequently used as the modeling material for patterns. The machinability of a bar was so bad that cutting of the bar with a cutting tool was impossible.

In the abrasion test which was carried out using molding silica sand No. 3 at 500 rpm for 3 hours, the amount of the square bar abraded was as large as 1.30%.

The evaluation results are summarized in Table.

COMPARISON EXAMPLE 5

Substantially the same wooden powder, ABS resin, apparatuses, and conditions as employed in Example 1 were employed. An aromatic hydrocarbon oil [Nisseki Hi-Sol SAS LH, manufactured by Nippon Petrochemicals Co., Ltd., $C_A$: 75 wt.%, viscosity: 300 cSt (100° F.)] was used as the hydrocarbon oil in an amount of 20 weight parts per 100 weight parts of the wooden powder for adsorption on and impregnation of the wooden powder. The ABS resin was then mixed with them in an amount that will provide an ABS resin content of 80 wt.%.

$\frac{1}{2}''\times\frac{1}{2}''\times 5''$ square bars were formed from the resulting mixture with a heat press, and evaluated as to machinability in the same manner as in Comparison Example 1. As a result, it was found that the bar was so very hard as compared with wood and so whitened in the cut surfaces that it was unsuitable as the modeling material. The cutting force with a handicraft knife was as large as 65 kg/cm$^2$, and the machinability was bad. Thus the bar formed in this Comparison Example turned out to be inferior to the corresponding one formed in Example 1. The results are shown together with other evaluation results in Table.

TABLE

| | ABS resin (wt %) | Wooden powder (wt %) | Amount of hydrocarbon oil added per 100 weight parts of wooden powder (weight part) | $C_A$ (wt %) | Bending rigidity (kg/cm$^2$) | Cutting force (kg/cm) | Machinability with chisel evaluated by wood-craftman | Amount of abrasion (cm$^3$) |
|---|---|---|---|---|---|---|---|---|
| Examples | | | | | | | | |
| 1 | 80 | 20 | 20 | 5 | 30,000 | 42 | excellent | 1.21 |
| 2 | 80 | 20 | 30 | 4 | 29,000 | 41 | excellent | 1.13 |
| 3 | 60 | 40 | 12.5 | 4 | 34,000 | 45 | good | 1.26 |
| Comparison Examples | | | | | | | | |
| 1 | 80 | 20 | 0 | — | 34,000 | 61 | bad (hard, whitening) | 1.30 |
| 2 | 100 | 0 | 0 | — | 22,000 | 62 | bad (hard, whitening) | 0.78 |
| 3 | 80 | 20 | 30 | 37 | 32,000 | 60 | bad (hard, sticky) | 1.10 |
| 4 | epoxy*1 resin | — | — | — | 100,000 | ≧70 | bad (hard) | 1.30 |
| 5 | 80 | 20 | 20 | 75 | 30,000 | 65 | bad (hard, whitening) | 1.15 |

*1Araldite SW404 manufactured by Ciba-Geigy Ltd.

As apparent from the Table, every modeling material according to the present invention has a cutting force of 50 kg/cm or less, thus demonstrating excellent machinability. The smaller the cutting force, the better the machinability with a cutting tool. The cutting force for wood is 20 to 35 kg/cm, while the one for epoxy resin (for example, Araldite SW404, manufactured by Ciba-Geigy Ltd.) exceeds 70 kg/cm.

The cutting force of the material which can be cut easily by a woodcraftsman with a chisel is under 50 kg/cm.

Besides, the modeling materials according to the present invention are excellent in abrasion resistance as demonstrated in the Table. For example, they are smaller in amount of abrasion than an epoxy resin (Araldite SW404) used as the casting modeling material.

As apparent from the above, in accordance with the present invention, it has become possible to provide an incpmparably excellent modeling material having adaptability to cutting machines and freedom of shaping which cannot be expected of wood, and abrasion resistance comparable with that of the epoxy resin, which can be employed not only as the modeling material for shaping having excellent machinability but also as the modeling material for sand casting.

What is claimed is:

1. A modeling material composition comprising a hydrocarbon oil having a viscosity of 10 to 500 cSt (100° F.) and an aromatic ring-forming carbon atom content ($C_A$) of 20 weight % or less, wood powder and an acrylonitrile-butadiene-styrene resin, said wood powder being present in an amount of 10 to 40 weight % based on the total amount of the wooden powder and the acrylonitrile-butadiene-styrene resin, said hydrocarbon oil being added in an amount to 10 to 50 weight parts per 100 weight parts of said wood powder, whose amounts described hereinabove are calculated in an air-dried state.

2. A composition as claimed in claim 1, wherein said wooden powder is one having said hydrocarbon oil adsorbed thereon and/or impregnated with said hydrocarbon oil before mixing thereof with the acrylonitrile-butadiene styrene resin.

3. A composition as claimed in claim 1, wherein said hydrocarbon oil is a naphthenic process oil.

4. A composition as claimed in claim 1, wherein said hydrocarbon oil is a paraffinic process oil.

5. A composition as claimed in claim 1, wherein the rubber component content of said acrylonitrile styrene resin is 5 to 40 weight %.

6. A composition as claimed in claim 1, wherein said rubber component content of said acrylonitrile-butadiene styrene resin is 10 to 30 weight %.

7. A composition as claimed in claim 1, wherein said wood powder is wood meal of a coniferous tree.

8. A composition as claimed in claim 1, wherein said wood powder is wood meal of Himalayan cedar.

9. A composition as claimed in claim 1, wherein said wood powder is wood meal of incense cedar.

10. A composition as claimed in claim 1, wherein the particle size of said wood powder is such that 90 weight % or more of said wood powder can pass through a 60-mesh sieve.

11. A composition as claimed in claim 1, wherein the particle size of said wood powder is such that all of said wood powder can pass through an 80-mesh sieve.

* * * * *